US005363987A

United States Patent [19]

Crawford et al.

[11] Patent Number: 5,363,987

[45] Date of Patent: Nov. 15, 1994

[54] NEWSPAPER VENDING UNIT

[75] Inventors: Danny E. Crawford; Gene A. Hall; Dennis A. Jendro; Dennis P. Rolph; Danny L. Nelson, both of Charles City, Iowa; Paul D. Elst, Green Bay, Wis.; Gregory E. Erlandson, Brooklyn Center, Minn.; Jack T. Mowry, N.W. Ramsey, Minn.; Robert L. Neiss, St. Michael, Minn.; Craig K. Loebig; Richard A. Helms, both of Elk River, Minn.

[73] Assignee: Seven, Ltd., Charles City, Iowa

[21] Appl. No.: 18,778

[22] Filed: Feb. 17, 1993

[51] Int. Cl.[5] ..... G07F 11/00

[52] U.S. Cl. ..... 221/195; 221/211; 221/232; 221/236; 221/155

[58] Field of Search ..... 221/211, 213, 195, 226, 221/232, 236, 238, 155, 244, 268, 272, 274

[56] References Cited

U.S. PATENT DOCUMENTS

| | | | |
|---|---|---|---|
| 1,982,999 | 12/1934 | Miller | 221/213 X |
| 2,432,415 | 12/1947 | Hatcher et al. | 221/213 X |
| 3,104,781 | 9/1963 | Clift | 221/195 X |
| 3,463,356 | 8/1969 | Gatti | 221/213 |
| 3,749,281 | 7/1973 | Stovers et al. | 221/298 |
| 3,917,114 | 11/1975 | Grosse | 221/251 |
| 3,957,175 | 5/1976 | Gordon | 221/215 |
| 4,139,120 | 2/1979 | Moore | 221/213 |
| 4,199,077 | 4/1980 | Lacewell | 221/213 |
| 4,258,861 | 3/1981 | Traill et al. | 221/213 |
| 4,296,873 | 10/1981 | Schlumpf | 221/213 |
| 4,367,826 | 1/1983 | Glaser | 221/213 |
| 4,389,000 | 6/1983 | Godley et al. | 221/8 |
| 4,413,749 | 11/1983 | Glaser | 221/1 |
| 4,473,172 | 9/1984 | Reynolds | 221/213 |
| 4,506,775 | 3/1985 | LeBron et al. | 221/213 X |
| 4,527,711 | 7/1985 | Harrell | 221/244 |
| 4,558,803 | 12/1985 | Draper et al. | 221/229 |
| 4,566,581 | 1/1986 | Martin | 194/248 |
| 4,566,608 | 1/1986 | Draper et al. | 221/229 |
| 4,569,461 | 2/1986 | Orr | 221/1 |
| 4,583,658 | 4/1986 | Israel | 221/213 |
| 4,655,369 | 4/1987 | Gabriel | 221/213 |
| 4,667,803 | 5/1987 | Gordon | 221/195 |
| 4,700,869 | 10/1987 | Bogner | 221/229 |
| 4,787,533 | 11/1988 | Haroutel et al. | 221/211 X |
| 4,889,221 | 12/1989 | Schlumpf | 194/345 |
| 5,000,345 | 3/1991 | Moore et al. | 221/195 X |
| 5,165,571 | 11/1992 | Schlumpf | 221/213 |

FOREIGN PATENT DOCUMENTS

| | | | |
|---|---|---|---|
| 8401649 | 4/1984 | WIPO | 221/211 |

*Primary Examiner*—David H. Bollinger
*Attorney, Agent, or Firm*—G. Brian Pingel

[57] ABSTRACT

A vending machine is designed to dispense multiple copies of a publication one at a time. The machine includes a storage member adapted to temporarily store multiple copies of a publication in a face-to-face orientation, a suction assembly formed of at least one suction cup that is adapted to seize and transport the front most copy of the publication to a dispensing position, a valve assembly associated with the suction cup to cause the cup to vent when in a dispensing position to dispense such copy into a delivery chute, and a slidable backplate biased to continuously urge the remaining copies of the publication forward.

10 Claims, 9 Drawing Sheets

NEWSPAPER VENDING UNIT

BACKGROUND OF THE INVENTION

1. Field of the Invention

The present invention relates in general to vending machines designed to dispense multiple copies of a publication and more specifically to such vending machines that dispense one copy of the publication at a time.

2. Description of the Prior Art

A variety of newspaper vending units are known in the art. However, to a large degree the most common newspaper vending units utilized for the vending of newspapers do not provide single copy vending. Instead, the commonly used newspaper vending units involve a housing in which multiple copies of a newspaper are stacked and a lid portion that is released when the proper amount of coins are placed in the unit to actuate a locking mechanism. Upon release of the locking mechanism, the lid can be raised and all of the copies of the newspaper are accessible and can be taken. As a result, theft of newspapers from conventional units frequently occurs and results in large losses to the newspaper publishing industry.

Because of the above noted deficiencies of the conventional newspaper vending units, numerous embodiments of single issue vending units have been disclosed and patented as evidenced by U.S. Pat. Nos. 3,463,356; 3,957,175; 4,889,221; 3,917,114; 4,296,873; 4,413,749; 4,506,775; 3,749,281; 4,199,077; 4,655,369; 4,139,120; 4,566,581; 4,700,869; 4,569,461; 4,583,658; 4,389,000; 4,258,861; 4,367,826; 4,527,711; 4,558,803; and 4,566,608.

In spite of the wide variety of dispensing assemblies as described in the above patents, there is still no widespread use in the newspaper industry or other vending industries in which single articles of publications are efficiently and effectively dispensed one at a time in a reliable fashion.

The present invention is designed to overcome the disadvantages of the above described inventions and is designed to provide vending of single issues of a publication reliably and efficiently.

SUMMARY OF THE INVENTION

The present invention provides a vending machine that when actuated by a user will dispense multiple copies of a publication one at a time and comprises an inclined storage means adapted to temporarily store multiple copies of the publication in a face-to-face relationship and in an upright orientation. Means are provided to seize and transport the front-most copy of publication and dispense such publication into a delivery chute. Means are also provided to continuously advance the remaining copies of the publication forward in a manner so that each successive front-most publication is in relatively the same position that the prior front-most publication was in prior to being dispensed.

DETAILED DESCRIPTION OF THE PREFERRED EMBODIMENT

Figure 1:
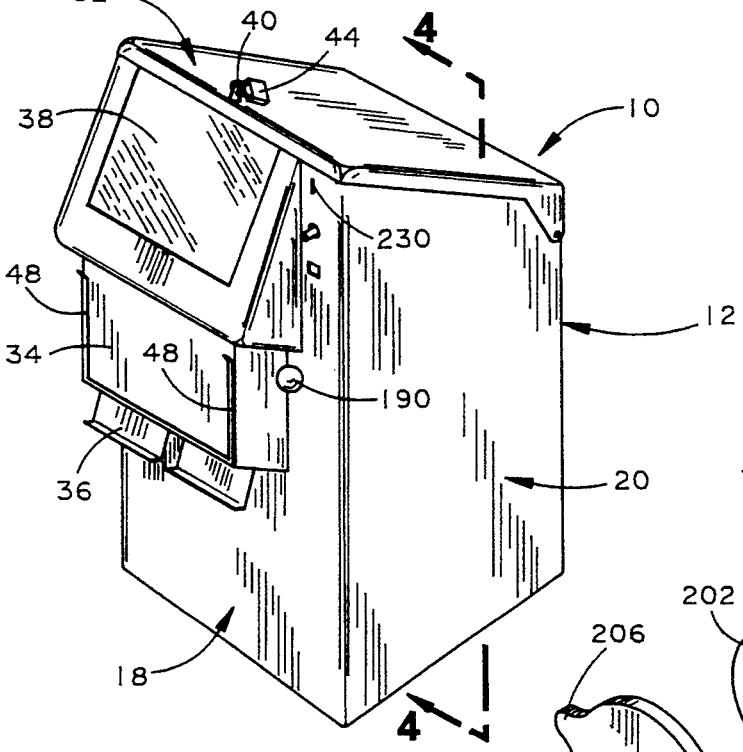
FIG. 1 is a front perspective view of a preferred embodiment of the publication vending machine of this invention.
Figure 17:
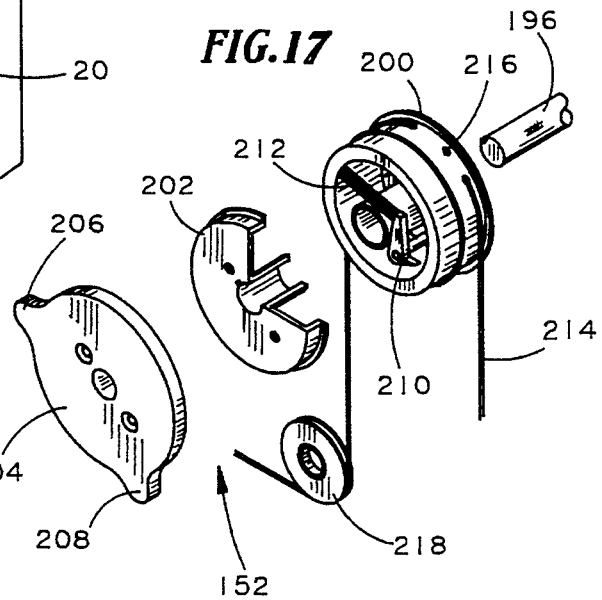
FIG. 17 is a partial exploded perspective view of a unidirectional clutch of the preferred embodiment of FIG. 1.
Figure 2:
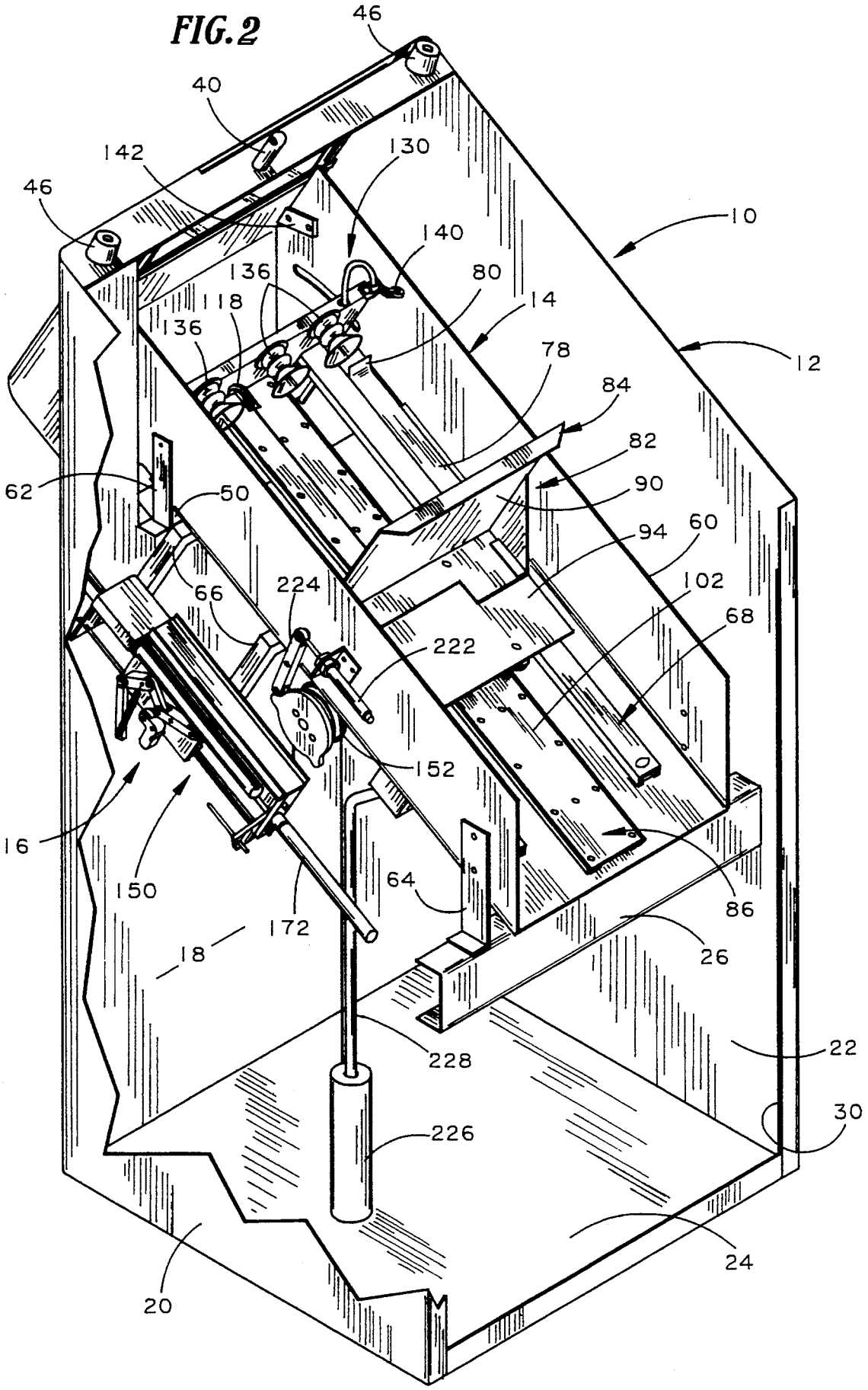
FIG. 2 is a rear perspective view of the preferred embodiment of FIG. 1 with top and rear covers removed, and the sidewall broken away to more clearly show the inner components.
Figure 3:
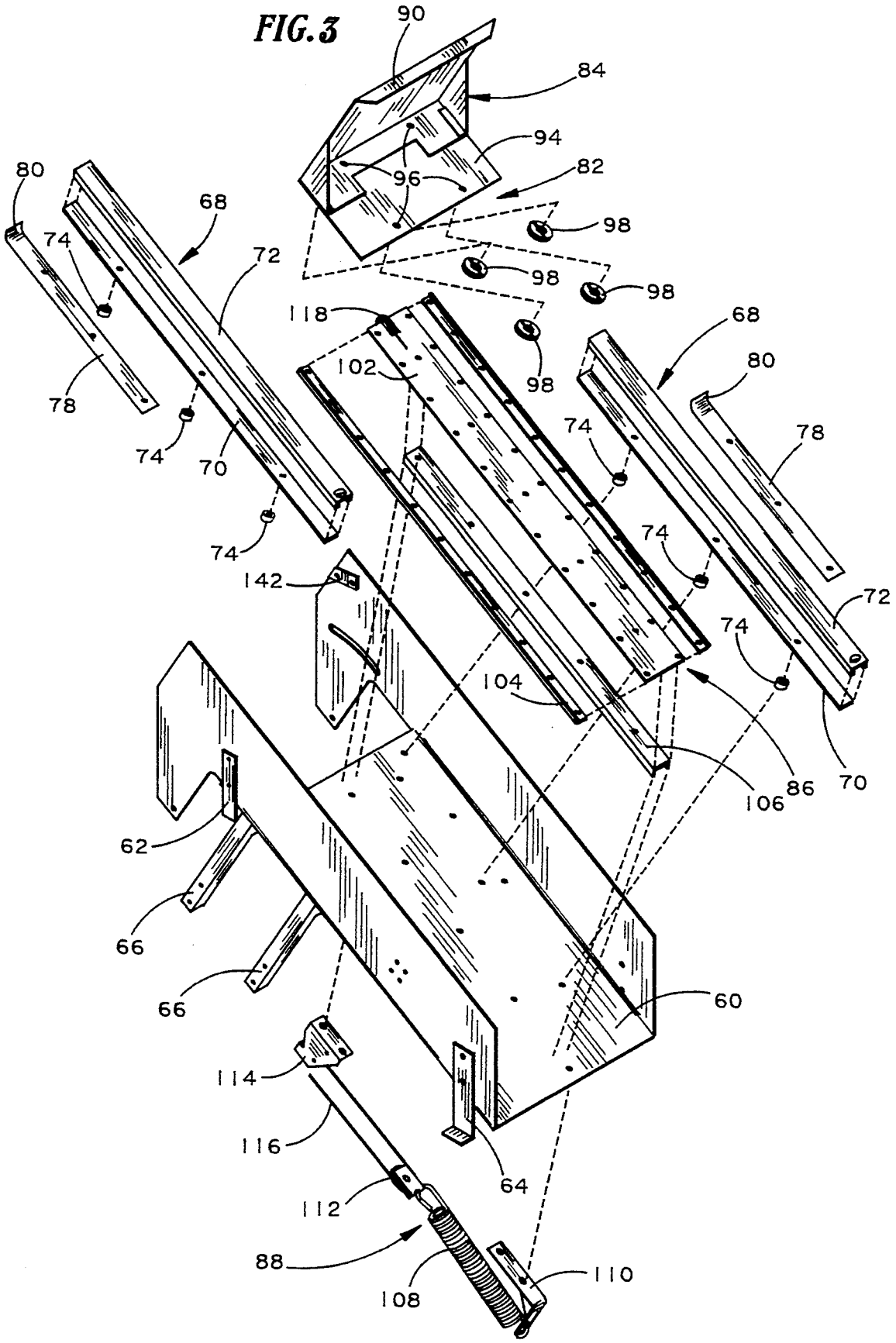
FIG. 3 is an exploded perspective view of the inner components of the preferred embodiment of FIG. 1 that make up a publication storage means.
Figure 4:
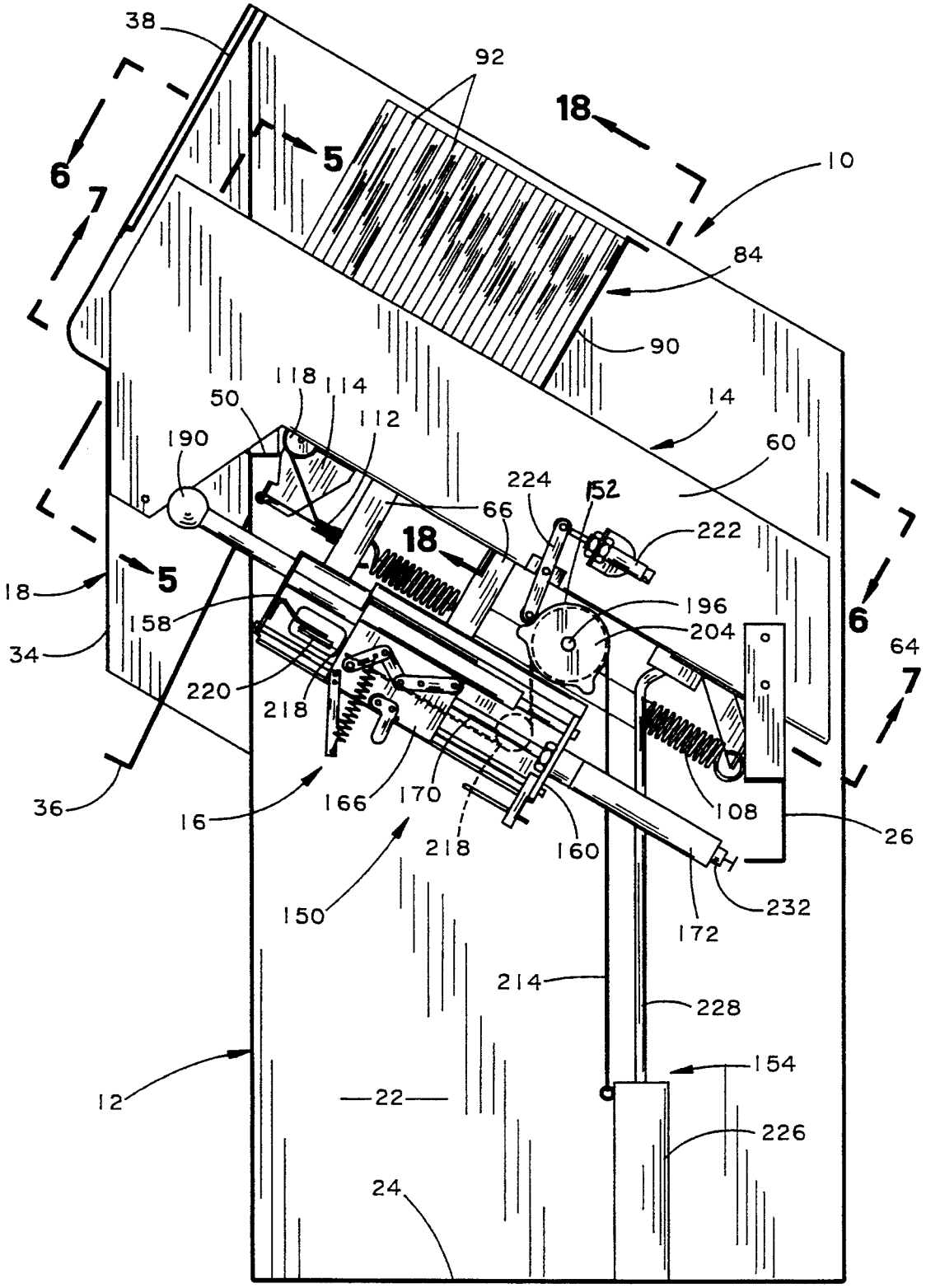
FIG. 4 is a right sectional side elevation view of the preferred embodiment of FIG. 1 taken along line 4—4 of FIG. 1 with tile actuator mechanism of this invention in a neutral, or at rest, position.
Figure 9:
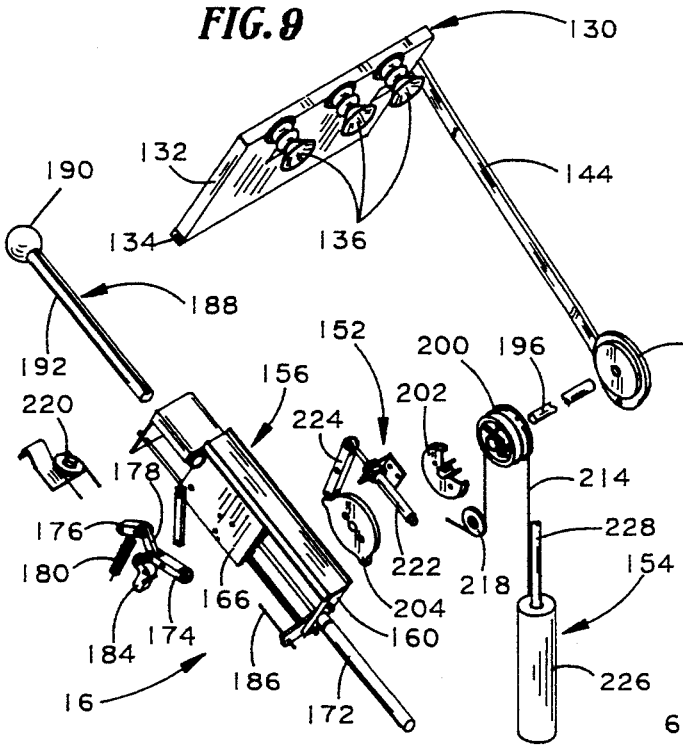
FIG. 9 is an exploded perspective view of an actuator mechanism of the preferred embodiment of FIG. 1.

With reference to the drawings, the publication vending machine of this invention is indicated generally as 10 in FIG. 1, and includes an outer cabinet 12 (FIGS. 1 and 8), a publication storage mechanism 14 (FIGS. 2, 3, 6, and 7), and an actuator mechanism 16 (FIGS. 2, 4, and 9).

Figure 8:
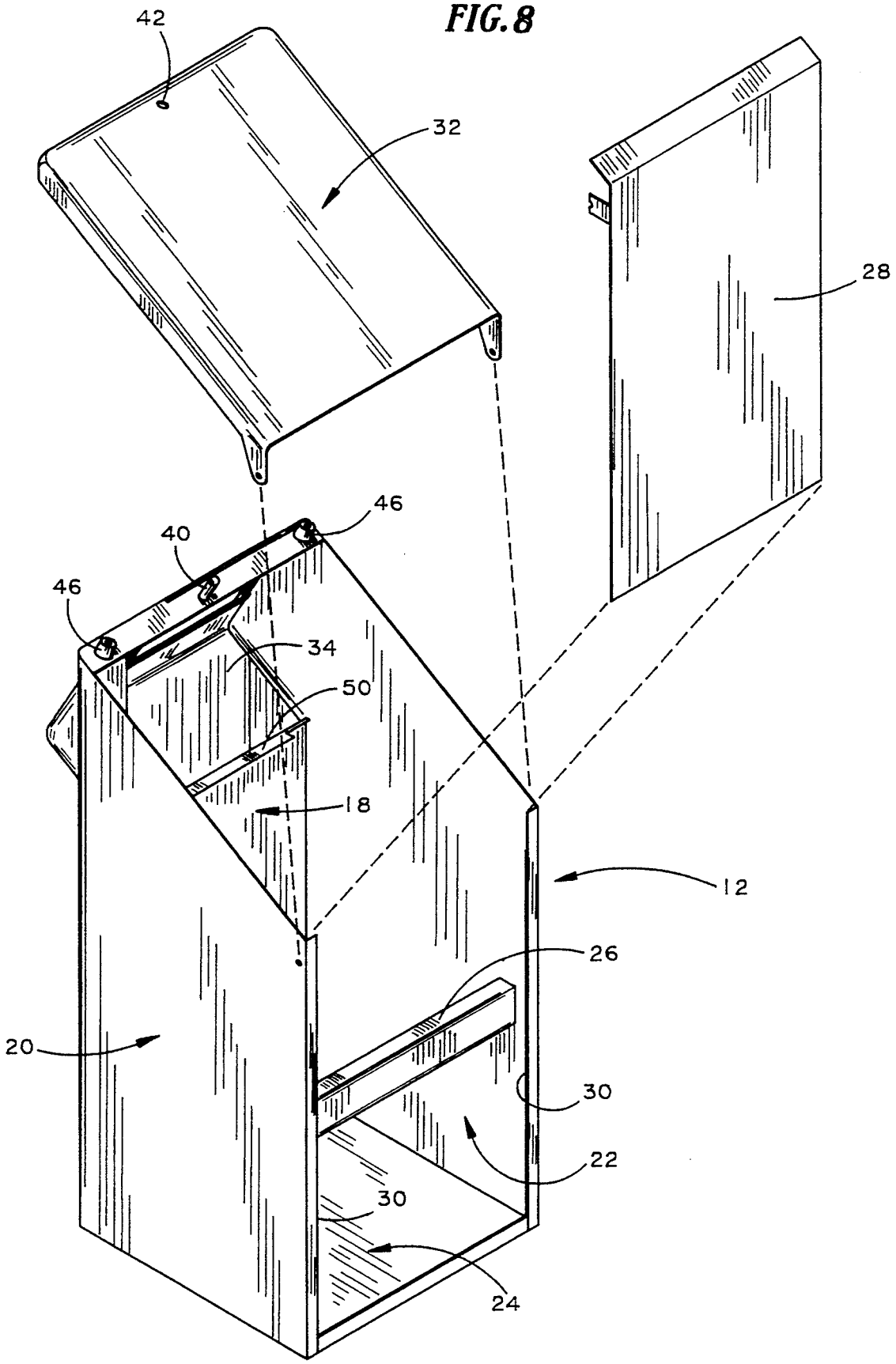
FIG. 8 is an exploded rear perspective view of the cabinet components of the preferred embodiment of FIG. 1.

As shown best in FIG. 8, the outer cabinet consists of a front panel assembly 18, right side panel 20, left side panel 22, floor panel 24, and a horizontal channel member 26 all of which are preferably formed from steel, and assembled by means of welding to form a unitized cabinet assembly. A removable rear panel 28 is slidably installed into tracks 30 formed in the rear edge of both side panels 20 and 22. A pivoting lid 32 is formed to extend over the front 18, and sides 20 and 22 to provide a waterproof cover.

As shown in FIG. 1, the front panel assembly 18 includes a chute 34, and a publication receiving tray 36. Also included is a window 38 through which the publication may be viewed prior to sale. Means are also provided on the front panel 18 for the internal mounting of a coin box, and mechanism release assembly (not shown) as is well known in the art. At the top center of the front panel assembly 18 is a steel stud 40 which, when lid 32 is closed, passes through a hole 42 in lid 32, and is securable by a padlock 44. Rubber bumpers 46 (FIG. 8) are provided to cushion the lid 32 when being closed. A car receiving track 48 (FIG. 1) is provided on the front panel 18 for the insertion of an advertisement. A lip 50 (FIG. 8) is formed on the inner side of front panel 18 and protrudes inwardly for a purpose to be described later. Thus it can be seen that the outer cabinet assembly 12 is constructed to be sturdy, weather proof, and theft resistant.

Referring now to FIGS. 2 and 3, the publication storage mechanism 14 is shown assembled into the outer cabinet assembly 12. The storage mechanism 14 consists of a generally "U" shaped tray 60 to which a pair of front mounting brackets 62 and rear mounting brackets 64 (only one of each which are shown) are fastened. The tray 60 is mounted to the outer cabinet assembly 12 by fastening the front mounting brackets 62 to the lip 50 of front panel assembly 18, and by fastening the rear mounting brackets 64 to the top surface of horizontal channel member 26. The vertical positioning of the horizontal channel member 26 is such that the rear edge of the tray 60 when assembled to the outer cabinet assembly 12 is downwardly inclined at about 30 degrees below horizontal. A pair of actuator support brackets 66 are fastened to the underside of tray 60 in order to support the actuator assembly 16.

Mounted to the inside top surface of the tray 60 are a pair of publication supports 68. Each publication support 68 consists of preferably a steel internal member 70, and an external sleeve 72 which is, in cross section, in the form of a "C" (FIG. 18), and is manufactured of a "slippery" plastic such as polyethylene to provide support to the publications while, at the same time, allowing them to be easily urged forward in a manner to be described later. Each of the publication supports 68 is spaced above the inside top surface of the tray 60 by three spacers 74, and secured by nut and bolt assemblies 76.

Immediately adjacent to each of the publication supports 68 are a pair of spring steel fingers 78 which are also fastened to the inside top surface to the tray 60. The front end of each finger terminates in an upwardly curved portion 80.

Figure 18:
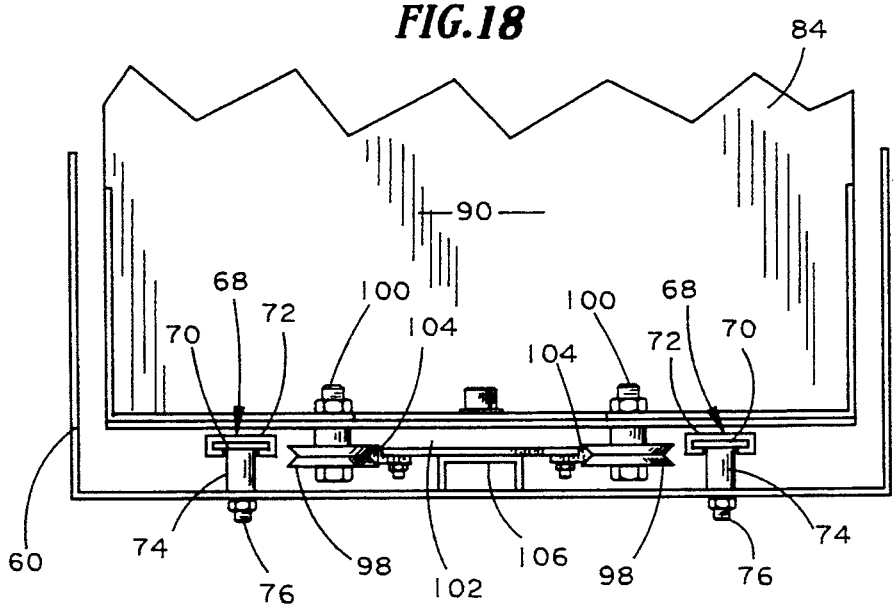
FIG. 18 is a rear sectional elevation view of the publication storage means taken along line 18—18 of FIG. 4.

A publication advancement mechanism that forms part of the storage mechanism 14 is shown generally at 82 in FIGS. 2 and 3 and consists of a movable publication back support assembly 84, a track assembly 86, and a counter balance spring assembly 88 (shown also in FIG. 3). The back support assembly 84 is generally "L" shaped in side elevation with a vertical portion 90 sized to fully support one or more copies of a publication 92 being stored. A horizontal portion 94 of the back support assembly 84 has four holes 96 through which four vee grooved rollers 98 are mounted by means of nut and bolt assemblies 100 (FIG. 18).

Referring to FIG. 3, the track assembly 86 consists of a central member 102, a pair of edge guide members 104, and a mounting member 106. The edge guide members 104 are fastened to the edge of the central member 102 and are tapered along one edge to accept the vee grooved rollers 98 of the movable back support assembly 84 in a free rolling engagement. The track assembly 86, along with the movable publication back support assembly 84, are supported by the mounting member 106 in a spaced relationship to the inside lower surface of the tray 60, and fastened by screws (not shown) along the centerline thereof.

The counter balance spring assembly 88 is fastened to the underside of tray 60 (FIG. 7) along the centerline directly opposite the track assembly 86. The counterbalance spring assembly 88 consists of: a spring 108; a spring attachment bracket 110, to which one free end of the spring 108 is attached; a pulley 112, which is attached to the other free end of the spring 108; a pulley bracket 114, attached to the underside front end of tray 60; a cable 116; and a pulley 118 rotatably mounted in the front end of the central member 102. One free end of the cable 116 is attached to a fixed object such as the pulley bracket 114. The cable 116 then passes over pulley 112, back over the pulley 118, and the other free end of the cable 116 is then fastened to the publication back support assembly 84.

Figure 5:
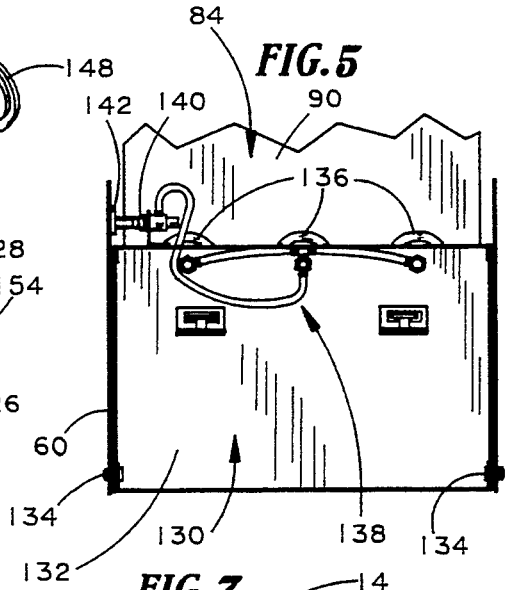
FIG. 5 is a partial elevation view of a publication feeding means of the preferred embodiment of FIG. 1 taken along line 5—5 of FIG. 4.
Figure 6:
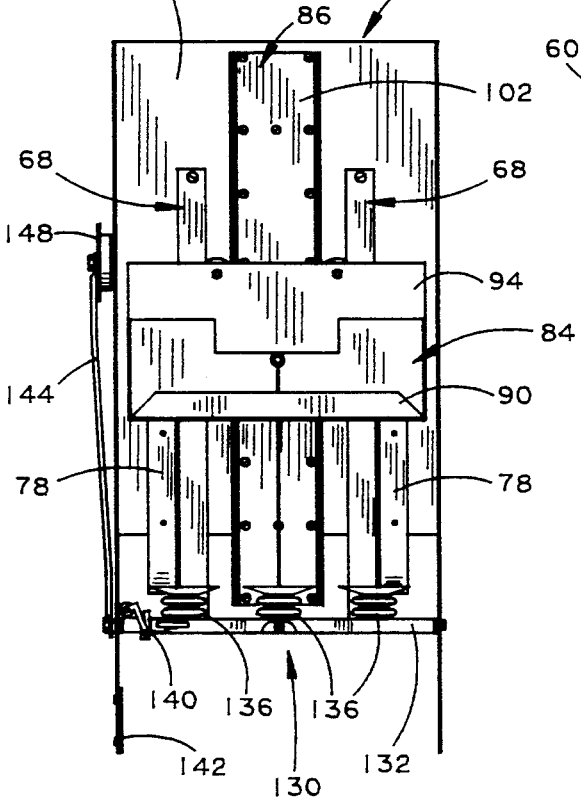
FIG. 6 is a top plan view of the publication storage and feeder means taken along line 6—6 of FIG. 4.
Figure 14:
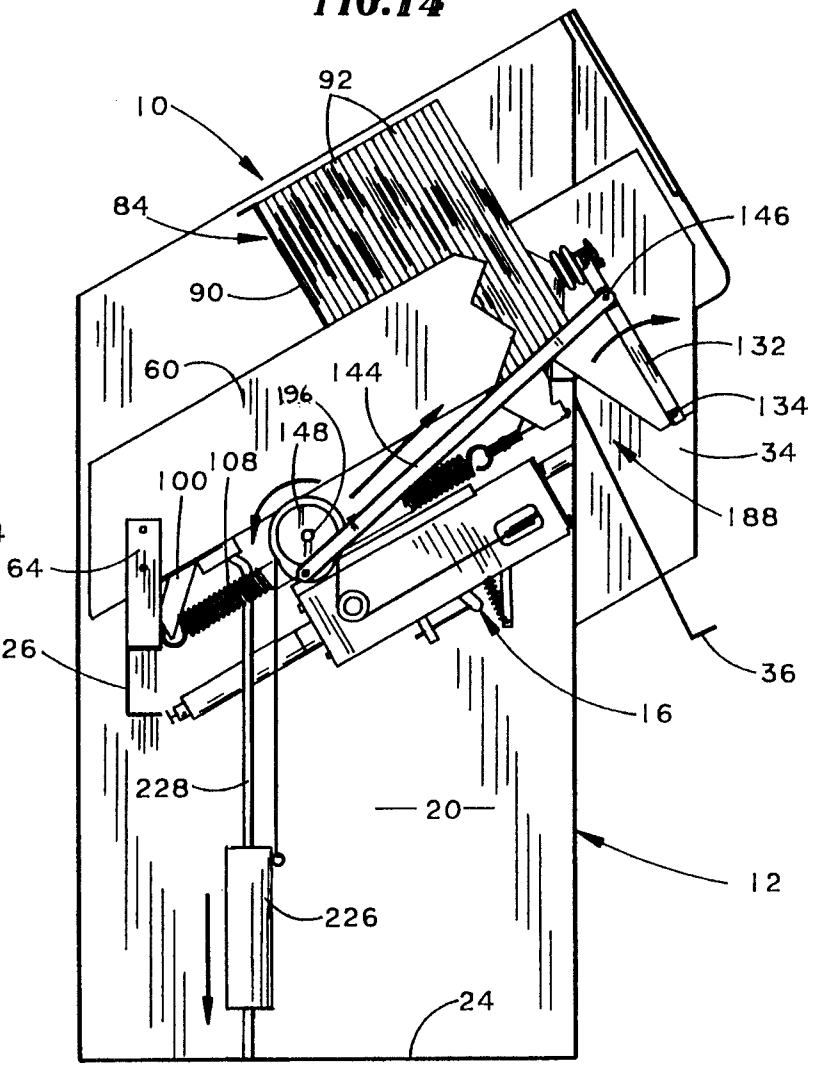
FIG. 14 is a left sectional side elevation view showing the publication feeder mechanism in a just activated position corresponding to FIG. 13.

A publication feeder assembly 130 is best shown in FIGS. 2, 9, and 14. The feeder assembly 130 consists of a gate member 132, which is pivotally supported between the vertical sides of the tray 60 at an axis location 134, directly over the outlet chute 34, in the front panel assembly 18. Mounted to the gate member 132 are three rubber suction cups 136. The gate member 132 and suction cups 136 are normally in an at rest engagement position with the front most copy of a stack of one or more copies of the publication 92, as shown in FIG. 14. The suction cups 136 are connected together at their closed ends by means of a system of fittings and tubing 138 which lead to a common vent valve 140, the purpose of which will be described later. A cam plate 142 (FIGS. 2 and 5) is mounted to the inside vertical sidewall of the tray 60 at a position that will trigger the vent valve 140 when the gate member 132 is pivoted about the axis location 134. A crank arm 144 is connected at one end to the gate member 132 at a pivot point 146, and at an opposite end is connected to an eccentric wheel 148.

The actuator mechanism 16 is comprised of a release assembly 150, a clutch assembly 152, and a weight assembly 154 (see FIGS. 4 and 9). The release assembly 150 is housed, and supported, in a housing assembly 156 consisting of a front plate 158, rear plate 162, and a top frame member 164. The release assembly 150 is attached to the tray 60 by means of the two brackets 66. Mounted in the housing assembly 156 is a slide plate 166 supported by a pair of vertically spaced apart guide rods 168 (FIG. 10), and free to slide along said guide rods 168. Connected to the rear edge of the slide plate 166, as seen in FIG. 4, is a piston rod 170 of a piston 172. The piston 172 is mounted through the rear plate 160. Mounted to the surface of the slide plate 166 are a series of levers, a link, and a spring.

Figure 10:
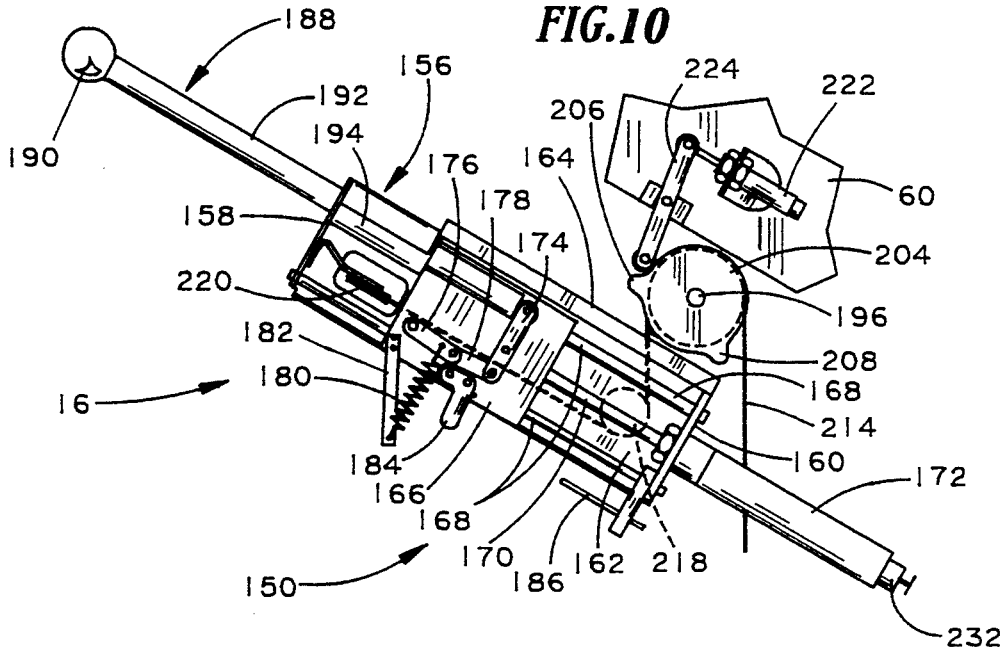
FIG. 10 is a right side elevation view of the actuator mechanism in a first changed position.
Figure 11:
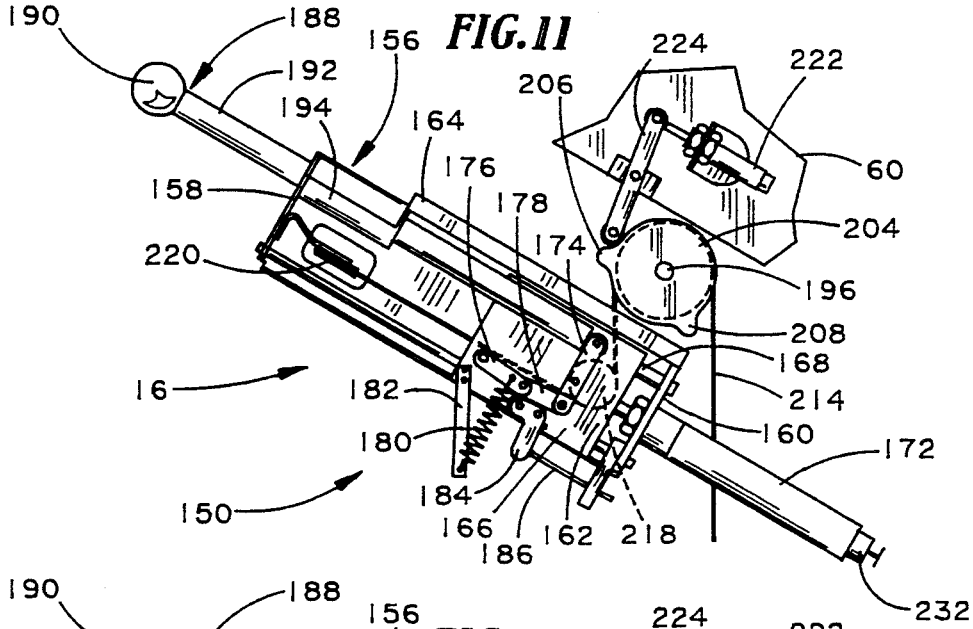
FIG. 11 is shown similar to FIG. 10 but with the actuator mechanism in a second changed position.
Figure 12:
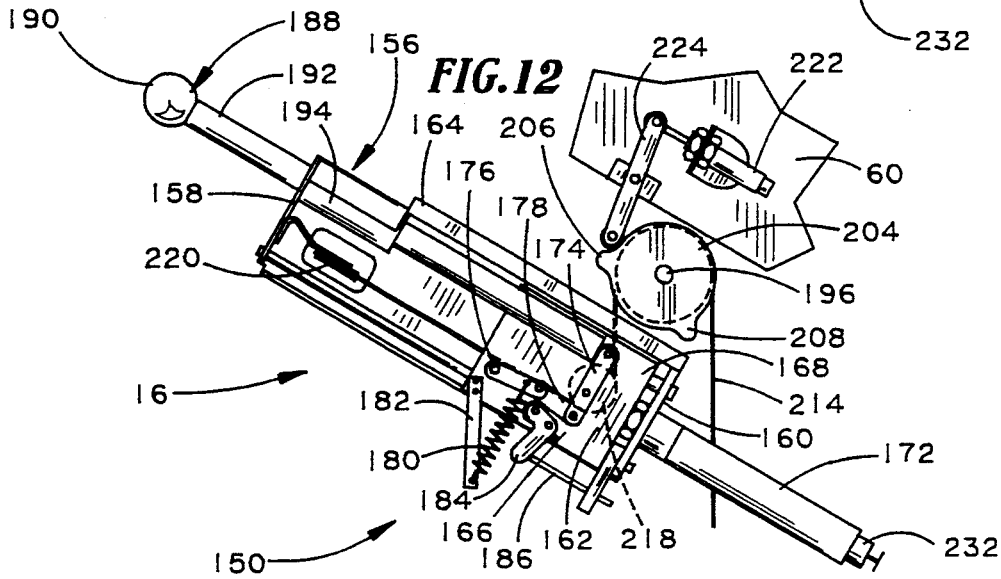
FIG. 12 is shown similar to FIG. 10 but with the actuator mechanism in a third changed position.

Referring now to FIGS. 10–12, a first lever 174 is connected to a second lever 176 by a link 178, Also connected to the lever 176 is a spring 180, whose opposite end is connected to a bracket 182. A third lever 184 is also mounted to slide plate 166, and is formed in the shape of an "L". Attached to the rear plate 160 is an adjustable trip rod 186 positioned to contact the third lever 184 when the slide plate 166 is in a rearward position (FIG. 11). A slide rod assembly 188 consisting of a knob 190, and a rod 192, is slidably received within the front plate 158 by means of a sleeve 194. The levers 174, 176 and 184, the spring 180, the link 178 and the trip rod 186 coacts together to form a trigger assembly that permits the rod 192 to be moved from an at rest position in an outward direction independent of the slide plate 166 but causes movement of the slide plate when the rod 192 is returned to its at rest position.

Figure 7:
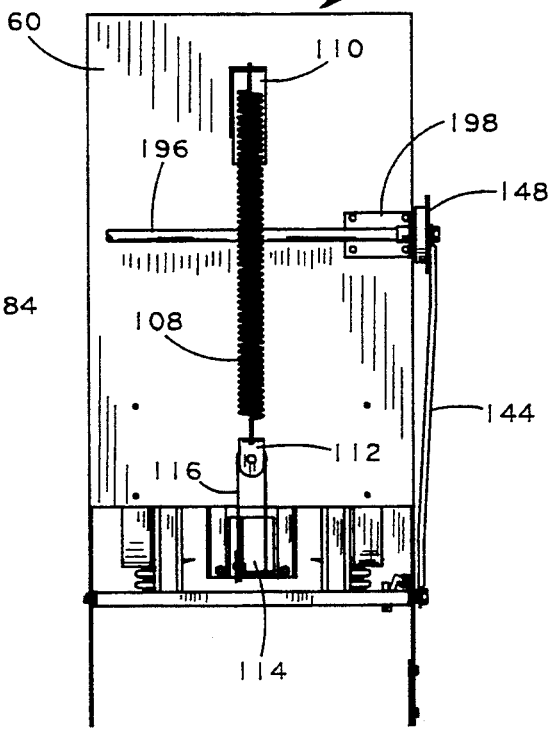
FIG. 7 is an underside plan view of the publication storage and feeder means taken along line 7—7 of FIG. 4.

The clutch assembly 152 is mounted on a shaft 196 which is, in turn, supported to the underside of tray 60 by means of a pair of bearing assemblies 198 one of which is shown in FIG. 7. The clutch assembly 152, as shown in FIG. 7, has an inner housing 200 which is journaled to, and free to rotate inside an outer housing 202. The outer housing 202 is keyed to the shaft 196. Also mounted to the outer housing 202 is a cam 204 having on its periphery a first cam lobe 206 and a second cam lobe 208. A pawl 210 is contained within the inner clutch housing 200 and is in ratcheting engagement with the outer clutch housing 202 by means of a spring 212.

A cable 214 is wrapped around the periphery of the inner clutch housing 200 and is fastened to keep from slipping by means of a set screw 216. One free end of the cable 214 passes around a first pulley 218, a second pulley 220 (FIG. 9) secured to the housing assembly front plate 158, and is connected to the front of the slide plate 166. The second free end of the cable 214 is connected to a weight 226 of the weight assembly 154. The weight 226 is guided vertically by a guide rod 228 connected at its bottom to the floor 24 and at its top to the tray 60.

The clutch assembly 152 is constructed so that the outer housing 202 will not rotate when the inner housing 200 is rotated in a counterclockwise direction (as viewed in FIG. 4), but will rotate in unison with the inner housing 200 when the housing 200 is rotated in a clockwise direction. Thus the outer housing 202, cam 204, and shaft 196, can only rotate in a unitary fashion in a clockwise direction.

With reference now to FIG. 4, an adjustable dampening cylinder 222 is mounted to the outer sidewall of the tray 60. A lever assembly 224 with rollers at both ends, and pivoted about its center, rides at one end on the cam 204, and at the opposite and against the plunger of dampening cylinder 222.

In operation, coins are deposited into a coin slot 230 on the front panel assembly 18. The coins enter a coin box (not shown) thus releasing the slide rod assembly 188 which can then be pulled outwardly from the at rest position shown in FIG. 4 to the position shown in FIG. 10 which allows the first lever 174 to be snapped to a vertical position. This is accomplished by means of the tension in the spring 180 acting upon the second lever 176, which is connected to the first lever 174 by the link 178. As can be seen in FIG. 10, the position of the levers 174 and 176 are such that they are now in an "over center" position and are thus locked against further movement.

When the slide rod assembly 188 is now pushed in, since lever 174 cannot be rotated back to its original position, the entire slide plate 166 is moved rearward along the guide rods 168. To limit the speed at which this can be done, piston 172 is equipped with an adjustable bleed valve 232 to control the retraction speed of the piston rod 170. While slide plate 166 is moving rearwards, the cable 214 is acting to rotate the inner clutch housing 200 in a counterclockwise direction. At the same time, the weight 266 is being raised up guide rod 228. However, no rotation of shaft 196 is taking place due to the clutch assembly 152.

Upon further pushing of the slide rod assembly 188 inwardly, the slide plate 166 reaches the position shown in FIG. 11 where the third lever 184 starts to make contact with the trip rod 186. The weight 226 has now reached its highest position. Continued pushing on the slide rod assembly 188 causes the trip rod 186 to push on the lever 184, which in turn pushes upwardly on lever 176 to release lever 176, link 178, and lever 174 from their locked position (FIG. 12) so that such levers return to their at rest position of FIG. 4. Upon the release of the lever 174 from its locked position, the slide plate 166 immediately starts to return to its original position by being acted upon by the cable 214 connected to the weight 226 by means of the pulleys 218 and 220, and the clutch assembly 152.

Figure 13:
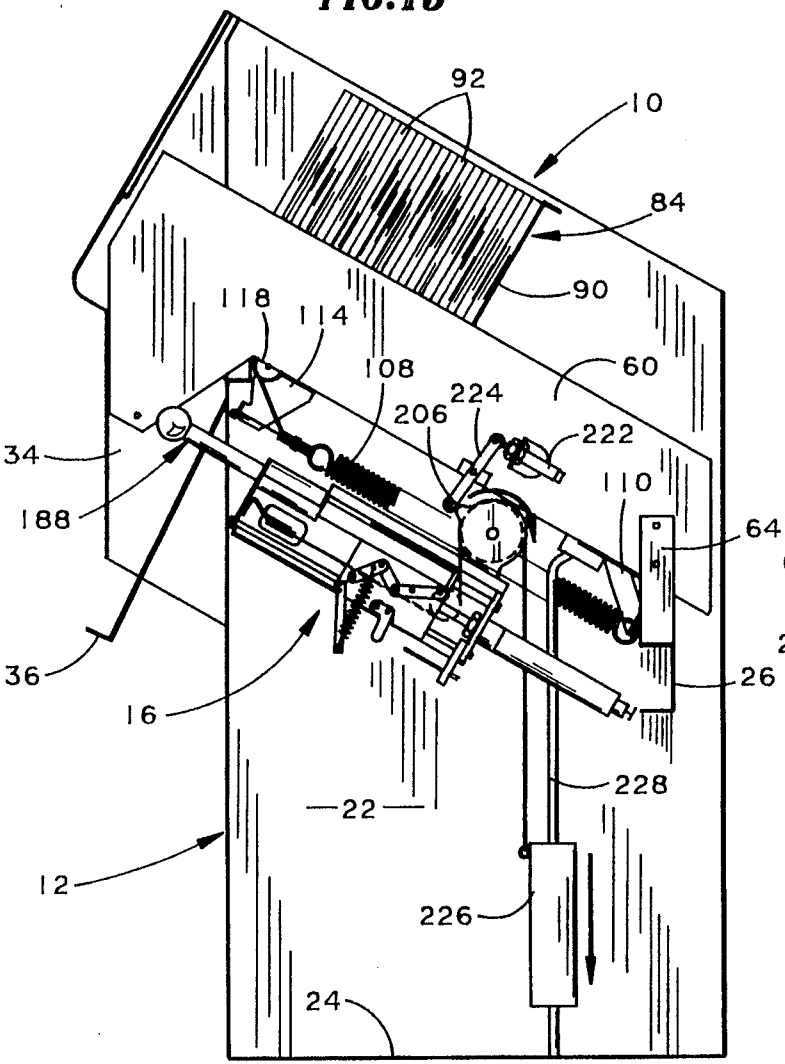
FIG. 13 is a right sectional side elevation view of the preferred embodiment of FIG. 1 with the actuator in a fourth position similar to FIG. 4, but with the publication feeder mechanism now activated.

With the inner clutch housing 200 now being rotated in a clockwise direction by the cable 214 being pulled by the weight 226, the pawl 210 engages the outer clutch housing 202. The outer clutch housing 202, cam 204, and shaft 196 are now all rotating in a clockwise direction. The clockwise rotation of the shaft 196 is slowed down by the lever assembly 224 coming into contact with the first cam lobe 206 of cam 204, and the opposite end being retarded against movement by the dampening cylinder 222. Thus a dwell time or lag is created in the rotation of the shaft 196. As rotation of the shaft 196 continues, the lever assembly 224 rides over the first cam lobe 206 (FIG. 13), and the rotation of shaft 196 speeds up.

Looking now at the opposite end of shaft 196 as seen in FIG. 14, the eccentric wheel 148 is keyed to the shaft 196, and therefore rotates in unison with such shaft. As the eccentric wheel 148 rotates in response to the rotation of the shaft 196, the crank arm 144 begins to move forward, and the gate member 132 begins to tilt forward. Because the suction cups are in engagement with the front most copy of the publication 92, as the gate member 132 begins to tilt forward, such copy is pulled forward by the suction cups 136. The upward curves 80 of the spring fingers 78 serve to ensure that only the front most copy is removed by catching on the second copy should it become stuck to the first.

Figure 16:
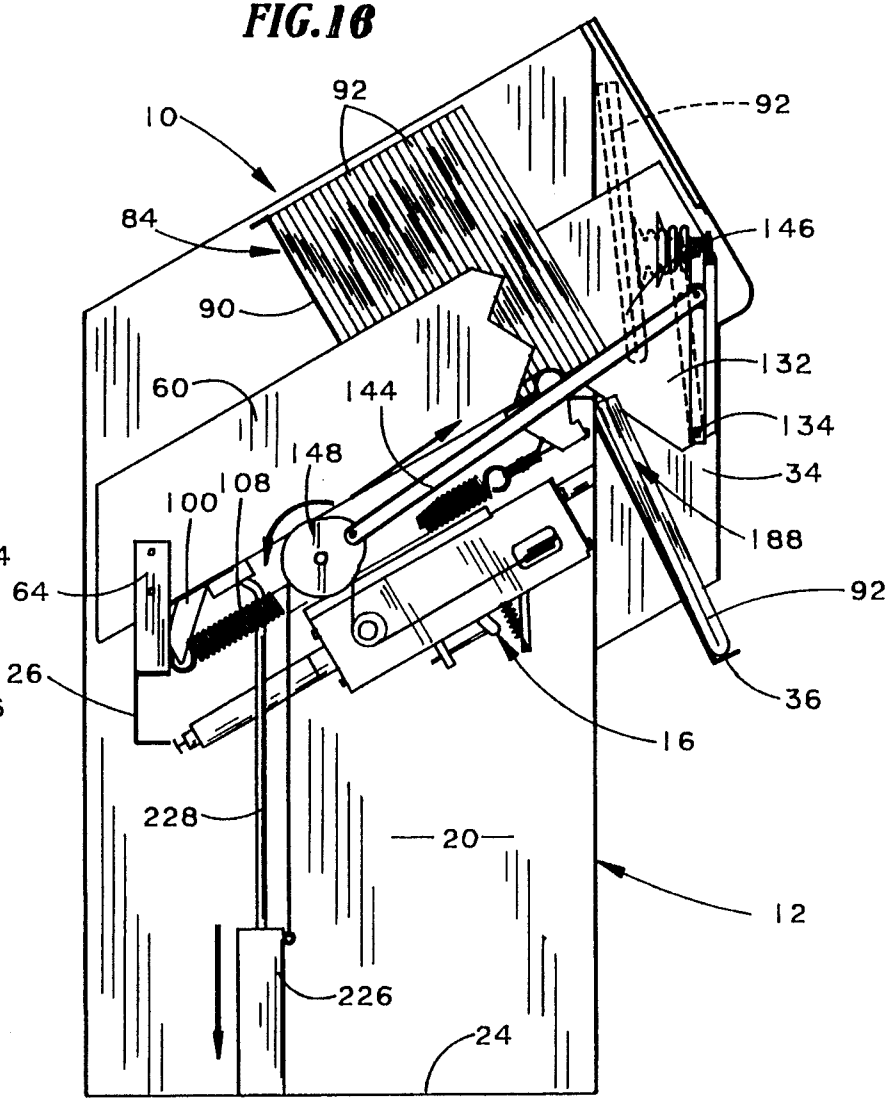
FIG. 16 is a left sectional side elevation view at the same corresponding moment as FIG. 15.
Figure 15:
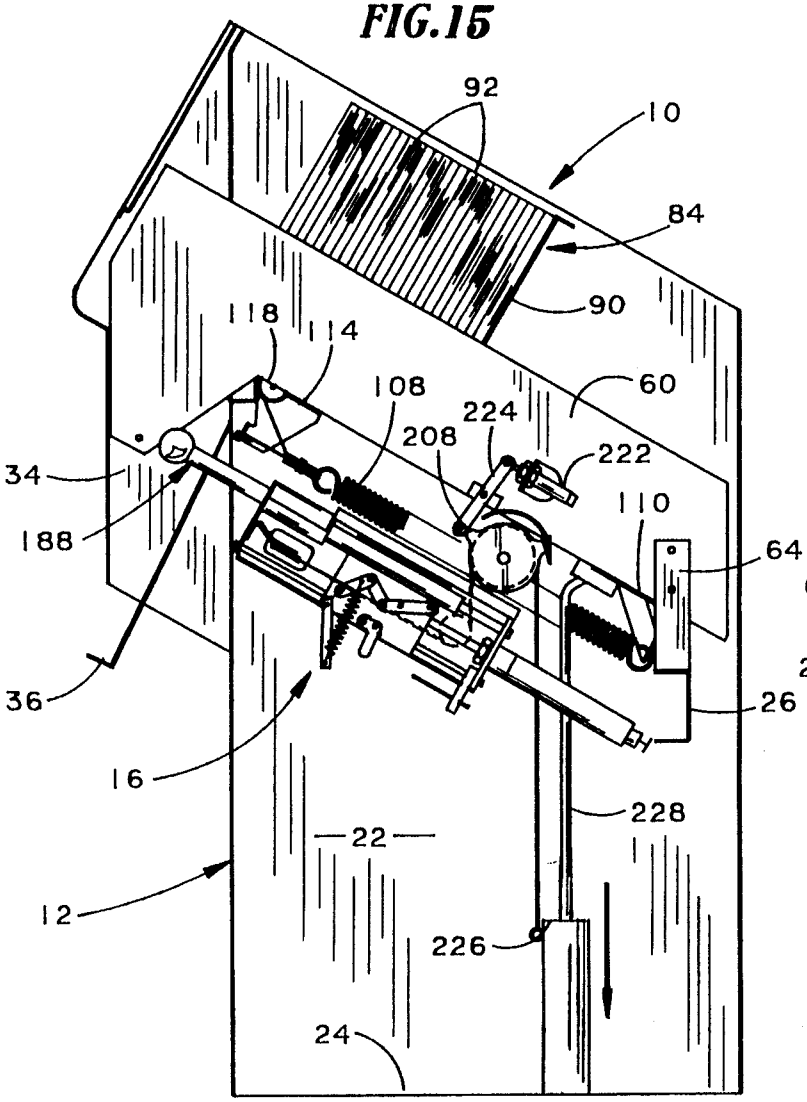
FIG. 15 is a right sectional side elevation view showing the position of the actuator and feeder mechanisms at the moment a publication is delivered to the outlet chute.

Rotation of shaft 196 continues to the position shown in FIGS. 15 and 16. At this point the gate member 132, along with the suction cups 136, and front most copy of the publication 92 have reached their furthest forward point of travel. This positions the publication directly over the discharge chute 34. When this position is reached, the vent valve 140 comes in contact with the cam plate 142 which simultaneously releases the vacuum in all three suction cups 136 by means of the fittings and tubing 138. The copy of the publication 92 is then dropped from the suction cups 136 into the chute 34 where it is caught by the tray 36. Rotation of the shaft 196, and thus the gate member 132 are again slowed down by lever assembly 224 coming into contact with the second cam lobe 208 of cam 204. This dwell allows the publication 92 to fall clear before the gate member 132 returns to its at rest position.

As the shaft 196 continues its rotation, the lever assembly 224 comes off of the cam lobe 208 which allows the gate member 132 to return to its at rest position with the suction cups 136 engaging the next copy of the publication 92. At the same time, the release assembly 150, clutch assembly 152, and weight assembly 154 are all returned to their original at rest positions.

The storage mechanism 14 is designed to always be in a state of balance regardless of the number of copies of the publication 92 in storage, and when one copy of the publication 92 is removed, the remaining copies are urged forward toward the suction cups 136. As copies of the publication 92 are added to the storage mechanism 14 the back support assembly 84 is pushed back down the track assembly 86 towards the rear of the tray 60. As this occurs, the tension of the spring 108 increases by means of the cable 116. So as more weight is added to the storage mechanism 14 by adding more copies of the publication 92, the more resistance to this weight is presented by the spring 108 until a point of equilibrium is reached. The tension in the spring 108 is calculated so that the point of equilibrium is such that no matter now many copies of the publication 92 are contained in the storage mechanism 14, the first publication 92 will always be engaged by the suction cups 136.

Although the invention has been described with respect to a preferred embodiment thereof, it is to be understood that it is not to be so limited since changes and modifications can be made therein which are within the full intended scope of this invention as defined by the appended claims.

I claim:

1. A vending machine designed to be actuated by a user and dispense multiple copies of a publication one at a time, said machine comprising:

(a) a storage means adapted to temporarily store multiple copies of the publication in a face-to-face relationship and support the same in a generally upright orientation;

(b) a feeder assembly adapted to seize and transport the front most copy of the publication from said storage means and dispense such publication into a delivery chute, said feeder assembly includes a suction means located directly in front of the front most copy of the publication and including at least one suction cup for seizing said copy;

(c) means actuated by the user to initiate operation of the feeder assembly;

(d) an advancement means adapted to continuously urge the remaining copies of the publication forward in a manner so that each successive front most publication is in relatively the same position that the prior front most publication was in prior to being dispensed; and (e) a release valve assembly associated with said suction cup to cause the suction cup to release said copy to dispense same.

2. A vending machine as recited in claim 1 wherein said storage means comprises:

(a) an inclined support means to provide support for said publications;

(b) a slidable backplate projected upwardly from said support means; and (c) a pair of oppositely situated side plates.

3. A vending machine as recited in claim 1 wherein said feeder assembly further includes an abutment affixed to the inside of the vending machine and located to the front of said suction means, said abutment is designed to contact said release valve assembly during movement of said feeder assembly to actuate said release valve assembly and disengage the feeder assembly from the front most copy of the publication.

4. A vending machined as recited in claim 1, wherein said feeder assembly comprises:

(a) a gate member pivotally secured to the front end of said storage means directly in front of the front most copy of said publication;

(b) a plurality of spaced apart suction cups for seizing said front most copy of said publication;

(c) valve means associated with said suction cups for venting said suction cups simultaneously; and (d) abutment means for actuating said valve means to release said copy from said suction cups.

5. A vending machine as recited in claim 4, wherein said machine further includes an actuator means that comprises:

(a) a weight assembly comprised of a vertically movable weight;

(b) a release assembly including a slide plate that is reciprocally movable between an at rest position located toward the front of said machine and an actuating position located toward the rear of said machine;

(c) a shaft operatively connected to said gate member in a manner that rotation of said shaft causes movement of said gate member;

(d) a clutch assembly mounted on said shaft and having an outer housing keyed to the shaft and an inner housing that is rotatable in one direction independent of rotation of the outer housing and rotatable in an opposite direction in unison with said outer housing; and (e) cable means attached at one end to said weight and at an opposite end to said slide plate and is wrapped around the periphery of said inner clutch housing in such fashion that as said slide plate is moved from its at rest position to an actuated position, said weight is elevated and as said slide plate returns to an at rest position, the clutch assembly and shaft are rotated to cause the movement of said gate member.

6. A vending machine as recited in claim 5 wherein said release assembly further includes:

(a) a slide rod assembly associated with said slide plate and reciprocally movable between an at rest position toward the rear of said machine and an actuated position toward the front of said machine; and (b) a trigger assembly associated with said slide plate to permit movement of said slide rod assembly to an actuated position without movement of said slide plate and causes movement of the slide plate when the slide rod assembly is returned to an at rest position.

7. A vending machine as recited in claim 5 wherein a dampening means is associated with said clutch assembly to retard the unitary rotation of said inner and outer housings of said clutch assembly.

8. A vending machine as recited in claim 5 wherein said gate member is connected to said shaft by means of an eccentric wheel keyed to the shaft so that the wheel rotates in unison width said shaft.

9. A vending machine as recited in claim 5 wherein said slide plate is associated with a piston having an adjustable bleed valve to control the movement of said slide plate in a rearward direction.

10. A vending machine designed to be actuated by a user and dispense multiple copies of a publication one at a time, said machine comprising:

(a) a storage means adapted to temporarily store multiple copies of the publication in a face-to-face relationship;

(b) a feeder assembly adapted to seize and transport the front most copy of the publication from said storage means and dispense such publication into a delivery chute, said feeder assembly includes a suction means located directly in front of the front most copy of the publication and including at least one suction cup for seizing said copy;

(c) means actuated by the user to initiate operation of the feeder assembly;

(d) advancement means adapted to continuously urge the remaining copies of the publication frontwardly in a manner so that each successive front most publication is in relatively the same position that the prior front most publication was in prior to being dispensed; and (e) a release valve assembly associated with said suction cup to cause the suction cup to release said copy to dispense same.

* * * * *